United States Patent [19]

Saitoh et al.

[11] Patent Number: 4,990,111

[45] Date of Patent: Feb. 5, 1991

[54] TILT DEVICE FOR MARINE PROPULSION UNIT

[75] Inventors: Hideki Saitoh, Numazu; Akihiro Onoue, Hamamatsu, both of Japan

[73] Assignee: Sanshin Kogyo Kabushiki Kaisha, Hamamatsu, Japan

[21] Appl. No.: 348,962

[22] Filed: May 8, 1989

[30] Foreign Application Priority Data

May 9, 1988 [JP] Japan ..... 63-110506

[51] Int. Cl.[5] ..... B63H 21/26

[52] U.S. Cl. ..... 440/61; 60/453; 60/464; 91/525

[58] Field of Search ..... 440/61; 91/525; 60/453, 60/464

[56] References Cited

U.S. PATENT DOCUMENTS 3,839,986 10/1974 Meyer et al. ..... 440/61

3,958,420 5/1976 Yokota ..... 60/453

*Primary Examiner*—Sherman Basinger

*Attorney, Agent, or Firm*—Ernest A. Beutler

[57] ABSTRACT

A hydraulically operated tilt and trim system having an arrangement for permitting retraction of the trim cylinders when the outboard drive is in its tilted up out of the water condition. An arrangement for bleeding air from the system and for adding make up fluid to the system through the trim retraction circuit.

4 Claims, 2 Drawing Sheets

TILT DEVICE FOR MARINE PROPULSION UNIT

BACKGROUND OF THE INVENTION

This invention relates to a tilt device for a marine propulsion unit and more particularly to an improved hydraulically operated tilt and trim unit wherein the trim cylinder can be moved to a retracted position when the outboard drive is tilted up and wherein the incorporation of this system will not adversely affect the normal operation of the device.

As is well known, many marine outboard drives employ hydraulic or power operated systems for effecting trim movement of the outboard drive between a fully trimmed down condition and a fully trimmed up condition and a tilt arrangement for moving the outboard drive from its fully trimmed up condition to a tilted up out of the water condition. One very popular form of system of this type employes a trim cylinder that is affixed to the transom of the watercraft and which has abutting engagement with the outboard drive for effecting the trim movement of the outboard drive. In addition, there is provided a tilt cylinder that has a connection to the watercraft and to the outboard drive and which is operative to tilt the outboard drive up to its fully tilted up out of the water condition from beyond the fully trimmed up condition.

Normally these systems are operated by a hydraulic circuit in which both the tilt and trim cylinders are operative throughout the trim range and wherein the tilt cylinder continues to operate the outboard drive when the trim cylinder is at the end of its stroke so as to achieve the tilting up operation. This type of arrangement means that the piston rod of the tilt cylinder is fully exposed when the outboard drive is tilted up beyond the fully trimmed up condition. There are a number of disadvantages to such an arrangement. Primarily, this means that the trim cylinder rod may be fully exposed for long periods of time even when the outboard drive and associated watercraft is not being operated. As a result, there can be corrosion or encrustation occur or other difficulties which can attack the piston rod of the trim cylinder and render it either inoperative or inefficient.

Therefore, there has been proposed a hydraulic system which, in addition to the aforenoted operation, permits the trim cylinder to be retracted once the tilt cylinder has the outboard drive in its tilted up condition. Normally, this is achieved through the addition of a further circuit between the actuating pump and the retraction side of the trim cylinder which includes a check valve that opens at a lower pressure than the pressure required to operate the tilt cylinder in a down direction. As a result, operation of the pump in a down mode will effect retraction of the trim cylinder without effecting retraction of the tilt cylinder.

Although the described modified hydraulic system for achieving trim cylinder retraction avoids the problems with the more conventional systems as aforenoted, it itself gives rise to certain difficulties. For example, the addition of this additional circuitry and its normally closed condition causes the system to be rendered sensitive to the intrusion or inclusion of air in the system during initial filling. As a result, air in the system can cause difficulties in operation. In addition, the provision of the valving as described can cause leakage of fluid out of the system and disadvantages in operation.

It is, therefore, a principal object of this invention to provide an improved tilt and trim cylinder assembly that will not present any of these disadvantages.

It is a further object of this invention to provide an improved tilt and trim cylinder arrangement and actuating system therefor where normal tilt and trim operation can be accomplished, the trim cylinder can be retracted when the outboard drive is tilted up and wherein air in the system will be self-purging and, furthermore, the likelihood of intrusion of air into the system during operation is reduced.

SUMMARY OF THE INVENTION

This invention is adapted to be embodied in a hydraulic tilt and trim device for a marine outboard drive that is comprised of an outboard drive unit that is adapted to be supported on the transom of a watercraft for movement between selected trim positions and a tilted up out of the water condition. A trim cylinder is operatively interposed between the transom and the outboard drive unit for moving the outboard drive unit between a trimmed down condition and a fully trimmed up condition. A tilt cylinder is operatively interposed between the transom and the outboard drive unit for moving the outboard drive unit at least between the fully trimmed up position and a tilted up out of the water position. The operative connection of the trim cylinder is such that it permits the outboard drive unit to be tilted up beyond the fully trimmed up position without operation of the trim cylinder. A fluid operating circuit including a pump and a reservoir is incorporated for selectively operating the cylinders between their respective positions and this system includes a circuit that permits trimming down of the trim cylinder from its fully trimmed up condition to its trimmed down condition when the tilt cylinder is in its extended position and the outboard drive is tilted up out of the water. In accordance with the invention, this circuit includes means for selectively communicating the circuit with the reservoir independently of a connection through the pump so as to permit air to be purged from the system.

DETAILED DESCRIPTION OF THE PREFERRED EMBODIMENT

Figure 1:
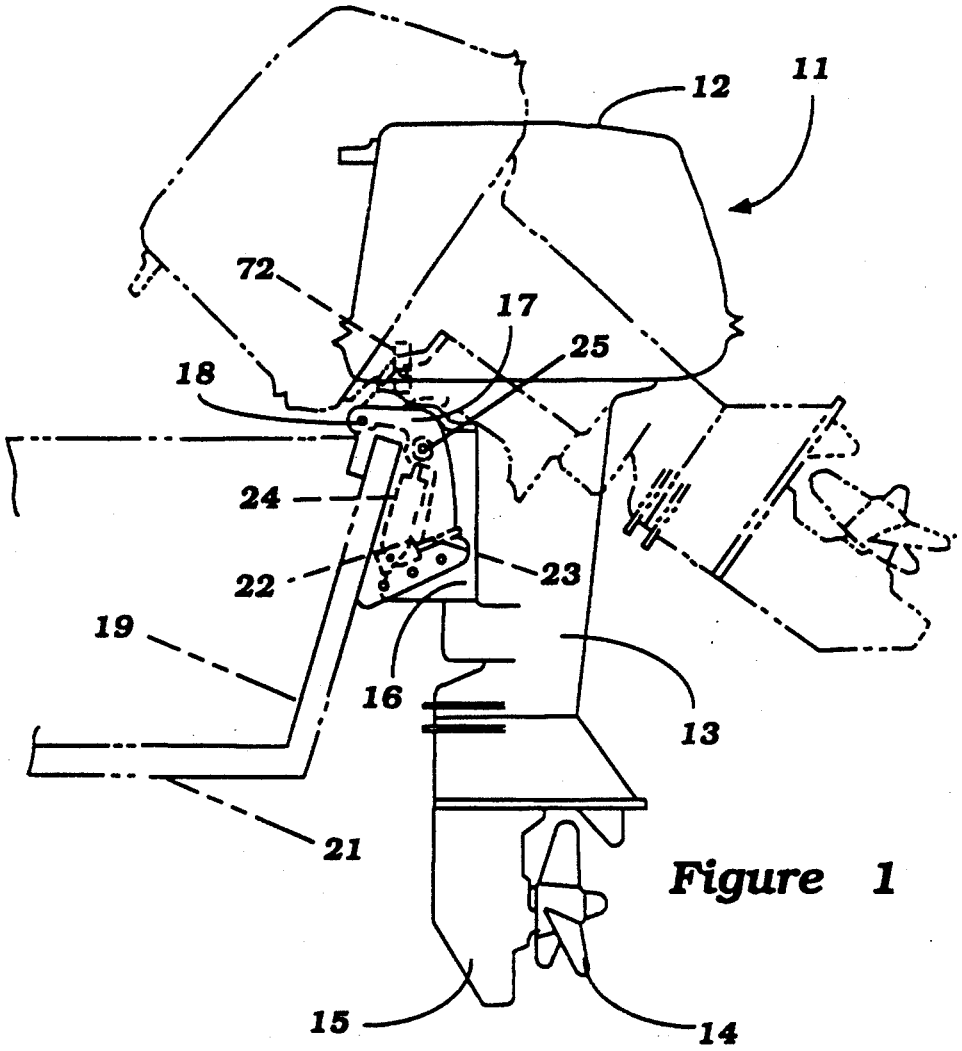
FIG. 1 is a side elevational view of an outboard motor as attached to the transom of a watercraft, shown partially and in phantom, and shows the outboard motor in its fully trimmed down condition in solid line views an in its tilted up out of the water condition in phantom lines.

Referring first to FIG. 1, a marine outboard drive is depicted generally by the reference numeral 11. In the illustrated embodiment, the outboard drive 11 comprises an outboard motor per se. It is to be understood, however, that the invention can be utilized with other forms of outboard drives such as the outboard drive unit of an inboard/outboard assemblage.

The outboard motor 11 includes a power head 12 that contains a powering internal combustion engine surrounded within a protective cowling. A drive shaft housing 13 depends from the power head 12 and contains a drive shaft (not shown) driven by the output shaft of the power head engine. This drive shaft drives a propeller 14 of a lower unit 15 by means of a conventional forward, neutral, reverse transmission (not shown).

A steering shaft (not shown) is affixed to the drive shaft housing 13 in a suitable manner and is supported for steering movement within a swivel bracket 16 about a vertically extending axis. The swivel bracket 16 is, in turn, pivotally connected to a clamping bracket 17 by means of a pivot pin 18 for tilt and trim movement of the outboard motor 11, in a manner to be described. The clamping bracket 17 includes a clamping device for affixing the outboard motor 11 to a transom 19 of a watercraft 21.

The movement of the outboard motor 11 about the pivot pin 18 for trim adjustment is achieved by a trim cylinder assembly 22 which in effect comprises a pair of trim cylinders which are carried by the clamping bracket 17 in a suitable manner. The trim cylinders 22 have piston rods 23 engaged with the swivel bracket 16 for effecting movement of the outboard motor 11 between a fully trimmed down condition as shown in FIG. 1 and a fully trimmed up condition, which is considerably lower than the tilted up condition as shown in the phantom line view of FIG. 1.

There is further provided a tilt cylinder assembly 24 that comprises a cylinder housing that is pivotally connected to the clamping bracket 18 and a piston rod 25 having a pivotal connection to the swivel bracket 16 for moving the outboard motor 11 from its fully trimmed up condition to the tilted up condition shown in phantom.

The construction as thus far described may be considered to be conventional and since the basic construction of the outboard drive and the specific construction of the tilt and trim cylinders forms no part of the invention, further description of these conventional components is not believed to be necessary to understand the construction and operation of the invention.

Figure 2:
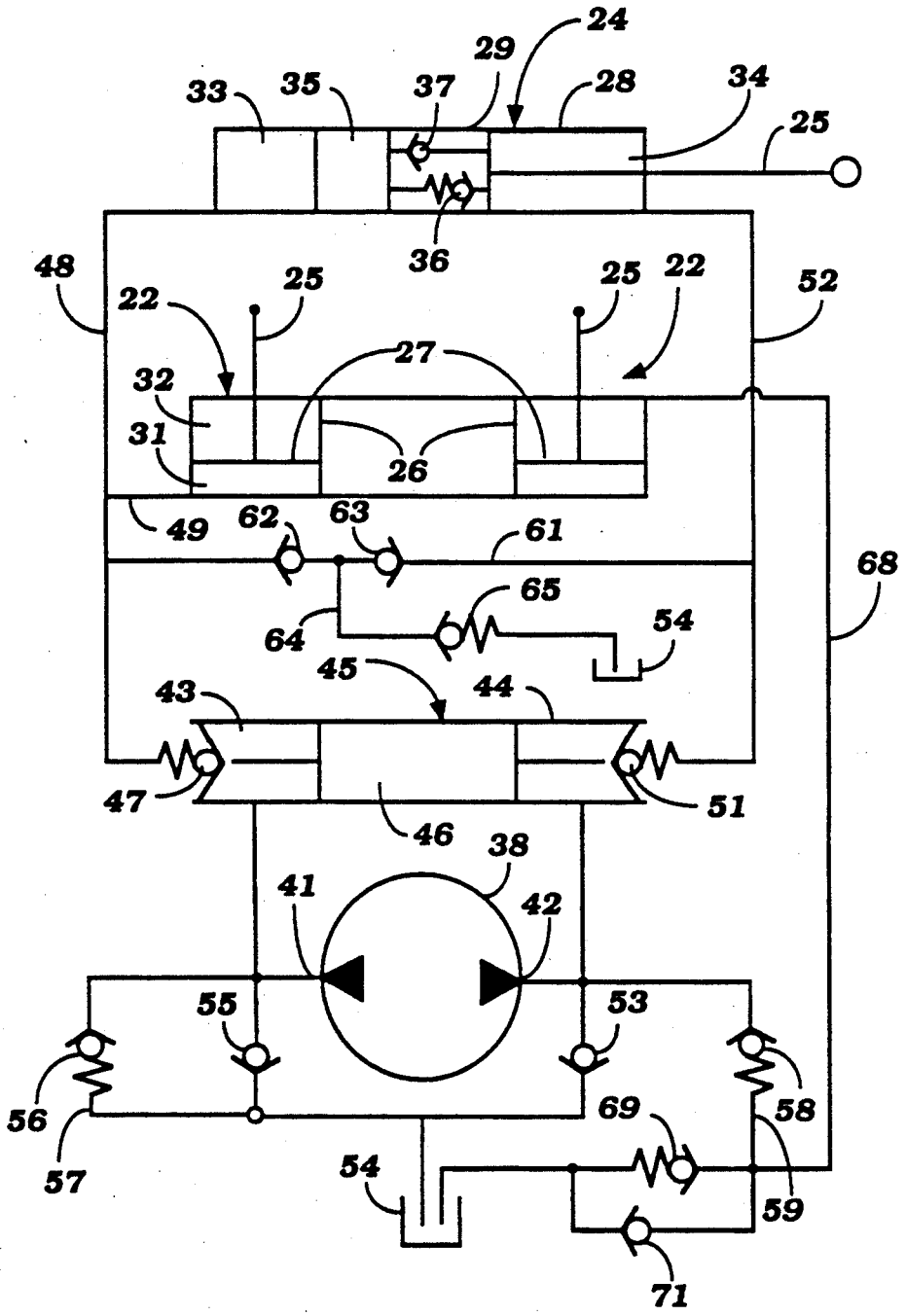
FIG. 2 is a partially schematic view of the hydraulic circuitry for the tilt and trim unit.

Referring now to FIG. 2, the hydraulic circuitry for operating the trim cylinders 22 and tilt cylinder 24 will be described in detail. As has been noted, the tilt cylinders, there being two in the illustrated embodiment, comprise cylinder housings, indicated by the reference numeral 26, that are adapted to be affixed to the transom 19 in a suitable manner, as via the clamping bracket 17 and which define internal bores in which pistons 27 are slidably supported. The pistons 27 are connected to the piston rods 25 that extend through one end of the cylinder assemblies 26 and which engage the swivel bracket 16 when the outboard motor 11 is no higher than in its fully trimmed up condition.

The tilt cylinder 24 includes a cylinder housing 28 that has a pivotal connection to the transom 19, for example, via the clamping bracket 17 and which slidably supports a piston 29. The piston 29 is affixed to the piston rod 25 which extends through one end of the cylinder housing 28.

It should be noted that the trim cylinders 21 have a substantially greater diameter than does the tilt cylinder 24 and; as will be described, the actuating circuitry for the trim cylinders 21 and tilt cylinder 24 is such that the trim and tilt cylinders 22 and 24 operate in parallel until the trim cylinders 22 reach the ends of their stroke. At this time, all of the hydraulic fluid will be diverted into the tilt cylinder 21 and the outboard motor 11 can be rapidly tilted up. The larger area of the trim cylinders 21 is necessary since the outboard motor 11 is normally trimmed up when operating under full power and, hence, the trim cylinders 22 must act against the driving power of the outboard motor.

The pistons 27 divide the trim cylinders 22 into lower chambers 31 and upper chambers 32. In a like manner, the tilt piston 29 divides the cylinder 18 into a lower chamber 33 and an upper chamber 34. A floating piston 35 is supported within the chamber 33 and normally engages one side of the tilt piston 27 so as to provide a memory for its trim adjusted condition.

There is provided a pressure responsive absorber valve 36 in a passage through the piston 29 so as to permit the outboard motor 11 to pop up, in a known manner, when an underwater obstacle is struck. A relief valve 37 operates in the opposite direction and will permit the outboard motor 11 to return to its previously trim adjusted position once the underwater obstacle is cleared. The floating piston 37 will insure that the outboard motor 11 returns to its previous trim adjusted position. The construction as thus far described is conventional.

The system is pressurized by means of a reversible fluid pump shown schematically at 38 and which is driven by a reversible electric motor under a suitable control. The reversible pump 39 has a pair of outlet ports 41 and 42 with the port 41 functioning as a trim up port for pressurization during tilt and trim operation, while the port 42 serves as the tilt down port for tilt down operation. When the port 41 acts as a pressure port, the port 42 will act as a return port and vice versa.

The ports 41 and 42 are connected by conduits to respective chambers 43 and 44 of a shuttle valve assembly, indicated generally by the reference numeral 45. The chambers 43 and 44 are formed on opposite sides of a shuttle piston 46.

A pressure responsive valve 47 interconnects the chamber 43 with a tilt and trim up pressure line 48 that extends to the chamber 33 of the tilt fluid motor 24 and which is intersected by a passageway 49 that extends to the trim up chambers 31 of the trim cylinders 22.

In a like manner, a pressure responsive valve 51 communicates the shuttle valve chamber 44 with a tilt down line 52 that communicates with the chamber 28 of the tilt cylinder 24.

A first check valve 53 interconnects the pump port 42 with a reservoir 54 so as to draw make up fluid from the reservoir 54 during tilt or trim up operation if required. In a like manner, a second check valve 55 connects the pump port 41 with the reservoir 54 for make up fluid in the event required during tilt down operation. A tilt up relief valve 56 is provided in a return conduit 57 leading to the reservoir 54 for tilt up relief. In a like manner, a tilt or trim down relief check valve 58 controls the flow through a passage 59 to the reservoir 54 for tilt down relief.

There is further provided a passageway 61 that interconnects the conduits 48 and 52 in which oppositely acting check valves 62 and 63 are provided. The check valves 62 and 63 are interconnected between their ends by a further relief line 64 in which a pressure responsive valve 65 is provided and which leads to the reservoir 54. The check valves 62 and 63 and relief valve 65 will operate also to relief excess pressure in either the tilt or trim up mode or in the tilt down mode. Also, this system permits retraction of the trim cylinders 22 when the outboard motor 11 is tilted up.

The system as thus far described may be considered to be conventional and the operation of this conventional system will now be described. If the system is as shown in FIG. 2 and it is desired to achieve either further trim up operation or tilt up operation, the electric motor driving the pump 38 is operated in a direction so that the port 41 becomes the pressure port and the port 42 becomes the return port. When the port 41 is pressurized, the chamber 43 of the shuttle valve 45 will be pressurized and the shuttle piston 46 will move to the right. A projection on the shuttle piston 46 will engage and unseat the check valve 51 so that the line 52 will communicate with the pump return port 42.

When the shuttle chamber 43 is pressurized, and sufficient pressure is generated in the chamber 43, the check valve 47 will open to pressurize the line 48. This will cause fluid to flow into the tilt cylinder chamber 33 to cause it to extend and to flow into the trim cylinder chambers 31 through the passage 49 to cause them to extend. The fluid displaced from the chamber 34 of the tilt cylinder 24 is returned to the pump port 42 through the line 52, open check valve 51 and shuttle valve chamber 44.

When tilt up operation is desired, the pump 38 is continued to be operated until the pistons 27 of the trim cylinders 21 reach the ends of their stroke. At this time, all fluid will be diverted to the chamber 33 of the tilt cylinder 24 and the outboard motor will be rapidly tilted up. Return fluid flow from the tilt cylinder chamber 34 still occurs in the manner previously described. With a conventional system, this extension of the trim cylinder piston rods 25 may leave them exposed for long periods of time and thus they would be unprotected from encrustation or corrosion. In order to provide protection under these circumstances, there is provided a further line 68 that extends from the check valve 58 and line 59 to the upper chambers 32 of the trim cylinders 22. The check valve 58 is designed so as to open at a substantially lower pressure than the pressure required to open the check valve 51 and also the check valve 47 so that when the operation now to be described occurs, the condition of the tilt cylinder 24 will not be affected.

Once the outboard motor is fully tilted up, the operator may retract the piston rods 25 by reversing the direction of rotation of the pump 38 so that the port 42 forms the pressure port and the port 41 forms the return port. When this happens, the check valve 58 will quickly open and the lines 59 and 68 will be pressurized so as to pressurize the trim cylinder chambers 32. The trim pistons 27 can then rapidly retract and fluid displaced therefrom can return to the reservoir 54 through the check valve 62 and relief valve 65. It is important that the operation of the pump 38 be discontinued as soon as the trim pistons 27 reach the ends of their stroke, otherwise a rapid pressure rise could occur in the port 42 that could effect opening of the valve 51 and tilt down movement.

If tilt down operation is required, the pump 38 is continued to operate at which time the pressure in the shuttle valve chamber 44 will be sufficient to cause the shuttle piston 46 to move to open the check valve 51 and effect tilt down operation by pressurizing the chamber 34 of the tilt cylinder to move the piston 29 to the left and retract the outboard motor 11.

In the construction as thus far described, there is the possibility that air trapped in the system can cause improper operation. Furthermore, because of the incorporation of the valve 58 and the circuit for effecting retraction of the trim cylinders 22, there is a possibility of leakage in the system that can cause a fluid loss which if not made up can cause difficulties. In accordance with the invention, therefore, there is provided a system for insuring that air will be bled out of the system at all times and further that make-up fluid can be added to the system.

For the first purpose, there is provided a pressure responsive check valve 69 in the line 68 downstream of the check valve 58 and communicating with the reservoir 54. As a result, when the trim cylinders 22 are trimmed up, fluid displaced from the chambers 32 may exit back to the reservoir 54 through the opening of the check valve 69. This will insure that any air that becomes trapped in the system can be expelled via this path.

In addition, there is provided in parallel circuit, an oppositely acting check valve 71 which will act to permit fluid to flow from the reservoir 59 into the line 68 when make up fluid is required. As a result, the system will be effective in purging air that may be entrapped either during or after servicing or which may otherwise enter the system and also make up fluid can easily be added to the system without any complication.

There is further provided a tilt up lock lever 72 that is carried by the clamping bracket 17 and which engages the swivel bracket 16 when the outboard motor 11 is fully tilted up so as to hold the outboard motor 11 in its tilted up position. The tilt up lock 72 is manually released when the operator desires to tilt the outboard motor down.

Although an embodiment of the invention has been illustrated and described, various changes and modifications may be made without departing from the spirit and scope of the invention, as defined by the appended claims.

We claim:

1. In a hydraulic tilt and trim system for a marine outboard drive comprised of an outboard drive adapted to be supported on the transom of a watercraft for movement between selected trim positions and a tilted up out of the water condition comprised of a trim cylinder operatively interposed between said transom and said outboard drive unit for moving said outboard drive unit between a trimmed down and a fully trimmed up condition, a tilt cylinder operatively interposed between said transom and said outboard drive unit for moving said outboard drive unit at least between said fully trimmed up position and a tilted up out of the water position, said operative connection of said trim cylinder being such to permit said outboard drive unit to be tilted up beyond said fully trimmed up position without operation of said trim cylinder, and a fluid operating circuit including a single pump and a reservoir for selectively pressurizing both of said tilt cylinder and said trim cylinder to effect tilting up and down of the outboard drive and trim up of the outboard drive and for permitting retraction of the trim cylinder when the tilt cylinder has tilted the outboard drive unit to its tilted up out of the water condition, the improvement comprising means for bleeding air from the system during its operation and for permitting make up fluid to be added to the system.

2. In a hydraulic tilt and trim system as set forth in claim 1 wherein the means for bleeding air from the system includes a pressure responsive check valve in a conduit leading from the pump port to the trim down side of the trim cylinders and communicating with a reservoir.

3. In a hydraulic tilt and trim system as set forth in claim 1 wherein the means for adding make up fluid to the system includes a check valve passageway communicating the reservoir with a conduit leading from the fluid pump to the trim down side of the trim cylinder.

4. In a hydraulic tilt and trim system as set forth in claim 3 wherein the means for bleeding air from the system includes a pressure responsive check valve in the conduit leading from the pump port to the trim down side of the trim cylinders and communicating with a reservoir.

* * * * *